United States Patent [19]

Simelunas et al.

[11] Patent Number: 4,614,154

[45] Date of Patent: Sep. 30, 1986

[54] PEANUT PRESS FEED MECHANISM

[75] Inventors: William J. Simelunas, Glen Rock; Agostino Aquino, Paterson; Nicholas Polifroni, Cliffside Park, all of N.J.

[73] Assignee: Nabisco Brands, Inc., Parsippany, N.J.

[21] Appl. No.: 632,964

[22] Filed: Jul. 20, 1984

[51] Int. Cl.[4] ..... B30B 9/06

[52] U.S. Cl. ..... 100/116; 100/45; 100/99; 100/215; 99/495; 177/25; 177/245; 222/55

[58] Field of Search ..... 100/116, 126, 127, 128, 100/129, 45, 218, 53, 99, 196; 99/495, 489; 414/21, 268, 271; 222/55, 58, 77; 177/25, 245

[56] References Cited

U.S. PATENT DOCUMENTS

| | | | |
|---|---|---|---|
| 565,228 | 8/1896 | Richards | 100/99 X |
| 1,631,037 | 5/1927 | Kochenderfer | 100/116 |
| 2,614,707 | 10/1952 | Bilterman | 414/271 |
| 3,086,564 | 4/1963 | Staff | 141/81 |
| 3,161,124 | 12/1964 | Stromberg | 100/45 |
| 3,266,096 | 8/1966 | Thomas et al. | 100/99 X |
| 3,805,689 | 4/1974 | Berger et al. | 100/215 X |
| 4,040,230 | 8/1977 | Pessel et al. | 100/215 X |
| 4,253,390 | 3/1981 | Hunt et al. . | |
| 4,343,233 | 8/1982 | Burgin | 100/116 |
| 4,391,185 | 7/1983 | Stanley . | |

FOREIGN PATENT DOCUMENTS

| | | | |
|---|---|---|---|
| 2045864 | 9/1970 | Fed. Rep. of Germany . | |
| 2848446 | 6/1979 | Fed. Rep. of Germany . | |
| 24790 | 2/1980 | Japan | 100/116 |
| 412578 | 11/1966 | Switzerland . | |
| 1324212 | 7/1973 | United Kingdom . | |

*Primary Examiner*—Peter Feldman
*Attorney, Agent, or Firm*—Richard Kornutik

[57] ABSTRACT

A peanut butter press feeding mechanism has a peanut supply hopper which is controlled by a release gate to supply a volumetric feeder. The volumetric feeder ensures that each of four intermediate holding hoppers at a peanut butter press are filled to capacity. A second release gate controls the outlet of the volumetric feeder, which releases the peanuts into a totalizing scale which weighs peanuts supplied to all four of the intermediate holding hoppers. The totalizing scale supplies peanuts to a conveying arrangement having diverting gates which supply the appropriate intermediate holding hopper with a full supply of peanuts. During operation of the peanut butter press, a predetermined amount of oil is removed from the peanuts based upon the total weight of the peanuts used. This is necessary since merely knowing the volume of the peanuts used is insufficient due to the fluctuations in density of each batch of peanuts.

11 Claims, 6 Drawing Figures

PEANUT PRESS FEED MECHANISM

BACKGROUND OF THE INVENTION

This invention relates to a peanut press and feed mechanism for removing a predetermined percentage of liquid from a product, and is particularly suited for removing a predetermined percentage by weight of oil from a supply of peanuts.

This invention may also be adapted for use in removing a predetermined pecentage of liquid from other products such as grapes, cocoa beans, nuts, herbs and spices, and the like.

It is well-known to extract liquid from a solid product, for example it is conventional to extract liquid from cocoa beans to form cocoa butter. In such a device, a predetermined amount of cocoa beans is loaded into a press. Pressure is applied to extract liquid from the cocoa beans, the separated liquid and solids being removed for further processing.

Also known are systems for extracting liquid from edible products, such as, that used for extracting juice from grapes and the like. Examples of such systems include U.S. Pat. No. 4,253,390 issued to Hunt et al., and in U.S. Pat. No. 4,391,185 issued to Stanley.

The Hunt patent relates to a system for extracting liquids from fruit. A hydraulic pressure unit is used to extract juice from fruit in a two-stage system. A control system is employed to provide a continuous feed of grapes through the system for maximum efficiency of juice extraction. This control means includes a volume detector as well as a moisture sensor and controls for automatically adjusting the system to the current input of grapes to the destemmer portion of the apparatus. However, Hunt does not use a volumetric feeder to feed a totalizing scale (or vice versa) so that a predetermined percentage of oil or other liquid may be precisely extracted from a predetermined volume of product fed to a press.

The Stanley Patent relates to a system for controlling a juice extraction facility. Here, a storage location for the fruit is used, together with a sizer for separating the fruit, for recycling excess fruit. A juice storage tank is employed, and is one of the measured control variables in that the level is controlled. The amount of fruit being recycled is also a measured control variable. The Stanley reference equalizes fruit flow to the extracters so as to minimize the amount of recycled fruit, and overall maintains a proper predetermined level in the juice storage tank. However, no totalizing scale is employed in the Stanley reference, nor is the weight a major factor in the process.

SUMMARY OF THE INVENTION

It is accordingly one object of the present invention to provide an improved feeding mechanism for a peanut press which is reliable, can be used to extract a precise amount of oil from peanuts on a weight basis, can efficiently use the entire volume of each individual hopper in a peanut press, and that can be operated manually or by machine control.

Another object of the invention is to provide a feed mechanism for determining both volume and weight of a portion of a product, the feed mechanism being adapted to measure out a second portion by volume and determining the weight of the second portion, and totalizing the weight of the first and second portions; and repeating until four portions have been measured and supplied to a peanut press.

Another object of the present invention is to extract a precisely measured amount of oil, on a weight basis, from a supply of peanuts while providing a volume of peanuts to a peanut press so as to fill each of the hoppers of the peanut press.

The peanut butter press feeding mechanism of the present invention has a peanut supply hopper which is controlled by a release gate to supply a volumetric fedder. The volumetric feeder ensures that each of four intermediate holding hoppers at a peanut butter press are filled exactly to capacity for optimum utilization of the peanut butter press. A second release gate controls the outlet of the volumetric feeder, which releases the peanuts into a totalizing scale which weighs peanuts supplied to all four of the intermediate holding hoppers. The totalizing scale supplies peanuts to a conveying arrangement having diverting gates which supply the appropriate intermediate holding hopper with a full supply of peanuts. During operation of the peanut press, a predetermined amount of oil is removed from the peanuts based upon the total weight of the peanuts used. This is necessary since merely knowing the volume of the peanuts used is insufficient due to the fluctuations in density of each batch of peanuts.

Further details and advantages of the present invention appear from the following description of a preferred embodiment shown schematically in the drawings.

DETAILED DESCRIPTION OF THE INVENTION

Figure 1:
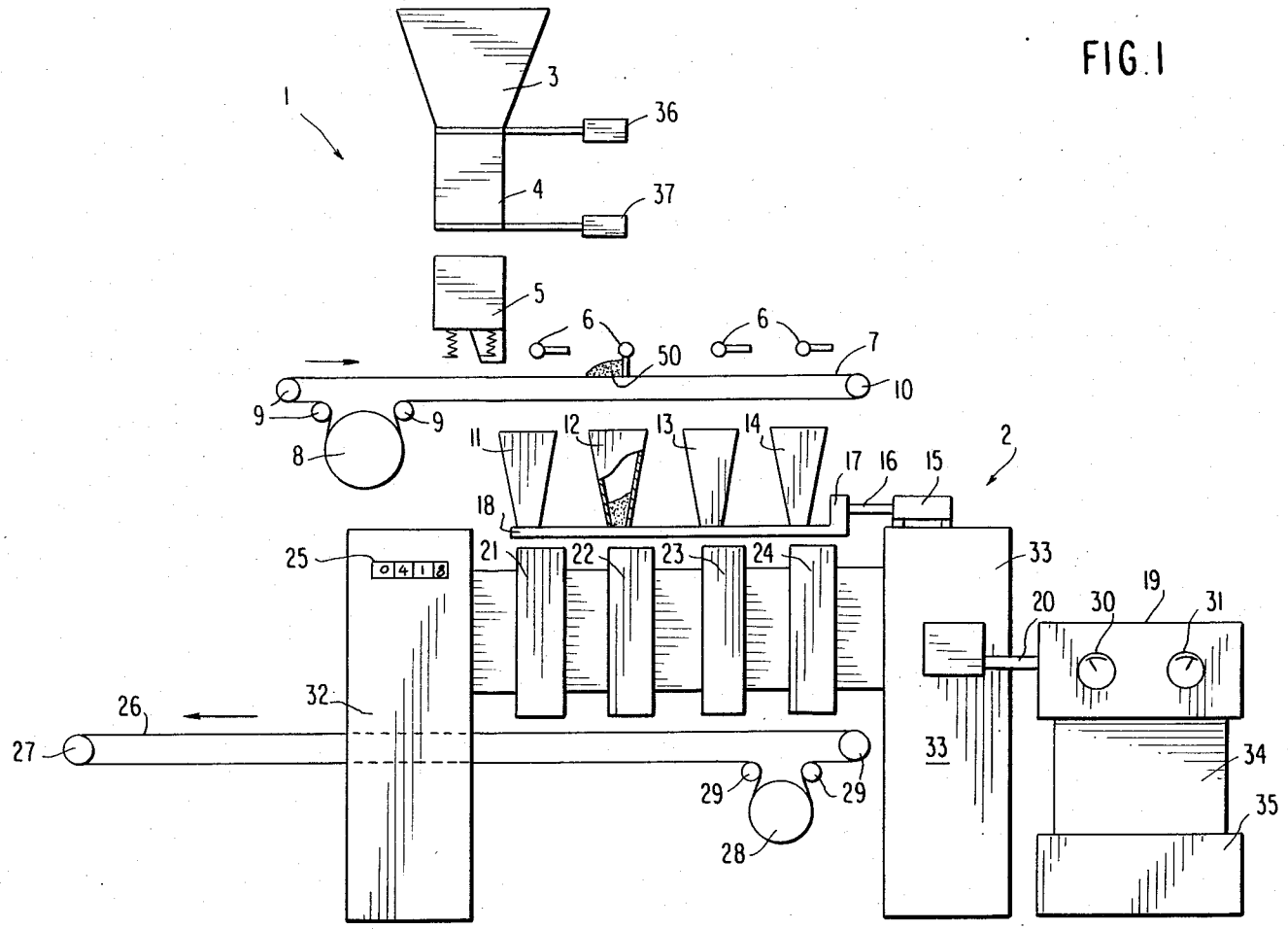
FIG. 1 shows a side elevational schematic view of a feeding mechanism for a peanut press used in the present invention.
Figure 2A:
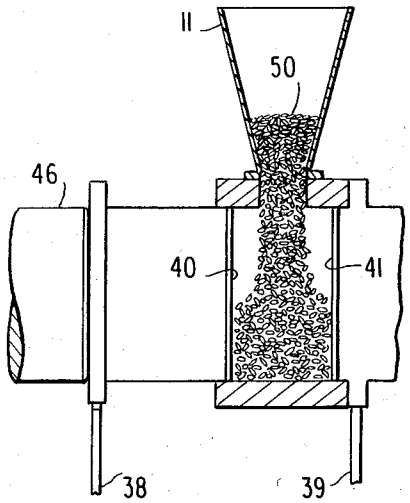
FIGS. 2(*a*), 2(*b*), 2(*c*), and 2(*d*) show side views, partially broken away, of the operation of the peanut press for a single hopper.
Figure 2B:
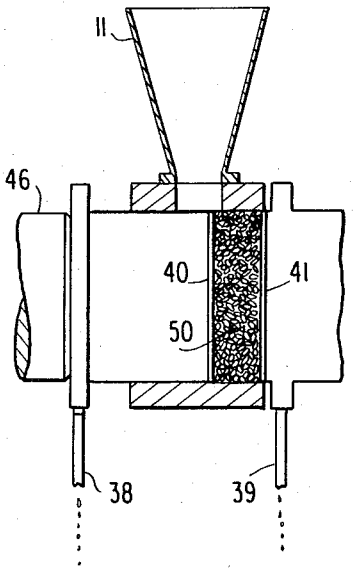
Figure 2C:
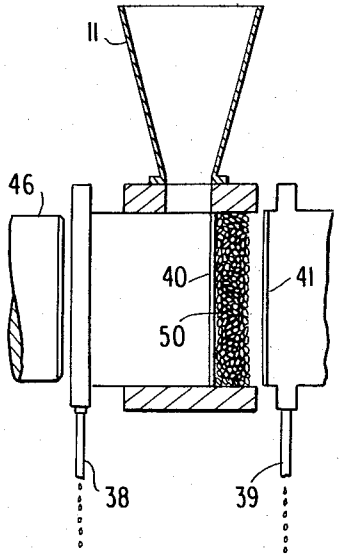
Figure 2D:
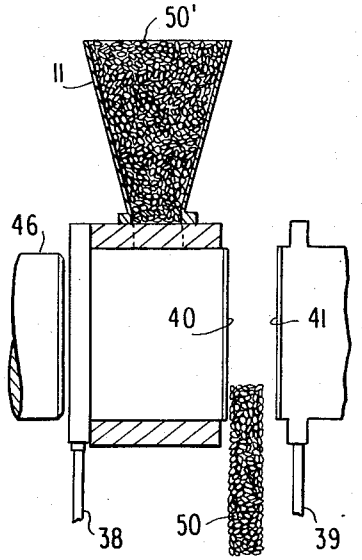

FIG. 1 is a side elevational view of a feeding mechanism 1 for a peanut press 2. An intermediate holding hopper 12 is shown partially broken away so that contents 50 are visible inside.

The feeding mechanism 1 has a feed mechanism supply hopper 3, for receiving a supply of peanuts. The level or height to which the supply hopper 3 is filled with peanuts can be arbitrary, or if desired, the level can be controled manually or automatically. This is not essential, however, to the present invention.

A volumetric feed chamber 4 directly underlies the supply hopper 3 and is separated by a supply hopper release gate 36. The bottom of the volumetric feed chamber 4 is closed off by a volumetric feed chamber release gate 37.

The supply hopper release gate 36 selectively is openable to permit entry of peanuts from the supply hopper 3 into the volumetric feed chamber 4. Also, the volumetric feed chamber release gate 37 is selectively openable to release peanuts from the volumetric feed chamber 4.

A totalizing weighing chamber 5 directly underlies the volumetric feed chamber 4. When the volumetric feed chamber release gate 37 is open, peanuts from the volumetric feed chamber 4 fall into the totalizing weighing chamber 5. In the volumetric feed chamber 4, the volume enclosed by the chamber 4 is a predetermined volume which is sufficient to completely fill one of the press chambers 21–24. The totalizing weighing chamber 5 determines the weight of the contents of peanuts received in the totalizing weighing chamber 5. The totalizing weighing chamber 5 also determines the total weight of four consecutive portions 50 of peanuts, which constitutes an operating cycle. At the end of each operating cycle, the totalized weight is reset to zero.

A feed conveyor belt 7 receives peanuts from the totalizing weighing chamber 5. The peanuts from the totalizing weighing chamber 5 may be evacuated from the chamber 5 by any known means, for example release of a trap door bottom, opening of a side door, or the like. The conveyor belt 7 moves to the right in FIG. 1, carrying peanuts 50 selectively past individual diverting gates 6. For each operation cycle, each of press chamber 21–24 are filled with a portion of peanuts equal to the volume of peanuts from the feed chamber 4.

Intermediate holding hoppers 11–14 directly underlie each of diverting gates 6. In FIG. 1, the diverting gate 6 directly overlying the second intermediate holding hopper 12 is in engagement with the peanuts 50, causing them to fall into the intermediate holding hopper 12. As seen in FIG. 1, a portion of the peanuts 50 has already fallen into the second intermediate holding hopper 12.

The conveyor belt 7 operates between small feed belt rollers 9 and a far small feed belt roller 10. A large feed belt roller 8 is also used.

A common fill gate member 18 closes the bottoms of each of the intermediate holding hoppers 11–14. The common fill gate member 18 is selectively movable so as to open the bottoms of the intermediate holding hoppers 11–14, by means of an upstanding fill gate member portion 17 which is operated by a connecting member 16 which is connected to a common fill gate operator 15.

When each of the intermediate holding hoppers 11–14 has received a portion of peanuts 50, the common fill gate member 18 is moved by the common fill gate operator 15 so that the peanut portions 50 fall into the press chambers 21–24. Each of the press chambers is separated by a movable piston member, a ram 46 being operable by means of a hydraulic pump 19 to apply an equal amount of pressure upon the peanut portions 50 contained within each of press chambers 21–24.

A total weight indicator 25 is set to indicate the total weight of the peanut portions 50 contained in press chambers 21–24. A product conveyor belt 26 directly underlies the press chambers 21–24, so as to receive the peanut portions 50 after oil has been removed therefrom. The conveyor belt 26 is operated by small conveyor belt rollers 29, a large conveyor belt operator 28, and a far conveyor belt roller 27.

The peanut press 2 is supported along the lefthand portion by a left peanut press end portion 32, and along the other portion by a right peanut press end portion 33. A hydraulic connecting hose 20 connects the peanut press 2 with the hydraulic fluid supply.

A hydraulic pump 19 has a hydraulic pump support base 35 and a hydraulic pump casing 34. A pair of gauges 30, 31 are used to monitor pressure within the hydraulic pump unit.

Oil extracted from the press chambers 21–24 during operation of peanut press 2 is extracted from the press chambers by individual oil run-off pipes 38, 39 (shown only in FIG. 2). FIG. 2 is a side view partially broken away of operation of the peanut press, and in particular of the peanut press portion directly underlying the intermediate holding hopper 11.

FIG. 2(*a*) shows a loading sequence of a press chamber directly underlying intermediate holding hopper 11. A portion 50 of peanuts is seen in the figure falling into the press chamber. The press chamber is defined by a volume bounded on either side by respective piston walls 40, 41. A ram 46 is adapted to act upon the piston shown in the figure as having a piston wall 40 adapted to act upon the peanut portion 50.

FIG. 2(*b*) shows compression in oil removal. Here, the ram 46 has moved to the right and pushed with it the slidable piston having piston wall 40. During this step, the closing piston having a piston wall 41 does not move. Oil leaves the press chamber from oil run-off pipes 38, 39.

When a predetermined amount of oil, by weight, has been removed, pressure release occurs. This is shown in FIG. 2(*c*).

In FIG. 2(*c*), a formed cake 50 has had a predetermined amount of oil removed therefrom. The piston having piston wall 41 then moves toward the right under the influence of ram 46.

In FIG. 2(*d*) no pressure is applied by the piston walls. The peanut portion, now a formed cake 50, falls downward and onto the conveyor belt 26 (shown in FIG. 1). A new charge of peanuts 50' has been received in the intermediate holding hopper 11. The ram is set to return to its original position, and with it piston walls 40, 41.

This type of press, having a ram 46, and pistons, as well as oil run-off pipes, is conventional in the cocoa butter press art. Therefore, no further detail is shown or needs be shown in the press, since its operation has been shown in the figures and since it is known in the art.

The cake 50 formed from each of the chambers of the peanut press has a predetermined amount of oil removed therefrom, on a weight basis. For precise determinations of oil content of peanuts, merely calculating the estimated amount of oil contained in a particular volume of peanuts is not sufficiently accurate. This is true due to the variation in density of peanuts for a given volume. Thus, the present apparatus relies on both a predetermined volume, and weighing of the weight of peanuts 50 supplied with each volume of peanut portions 50. Based upon the weight of peanuts supplied, and not on the volume, pressure is applied to the peanuts until a predetermined weight of oil has been removed. This weight of oil corresponds to the desired percentage by weight, of oil desired to be removed from the previously measured total weight of all the peanuts. Thus, the totalized weight is important. Due to the construction of the peanut press of the present invention, an equal amount of pressure is applied to each of the press chambers 21–24, Thus, under equal pressure, an equal percentage of oil, by weight, is extracted from the peanut portions 50 in respective chambers 21–24.

Figure 3:
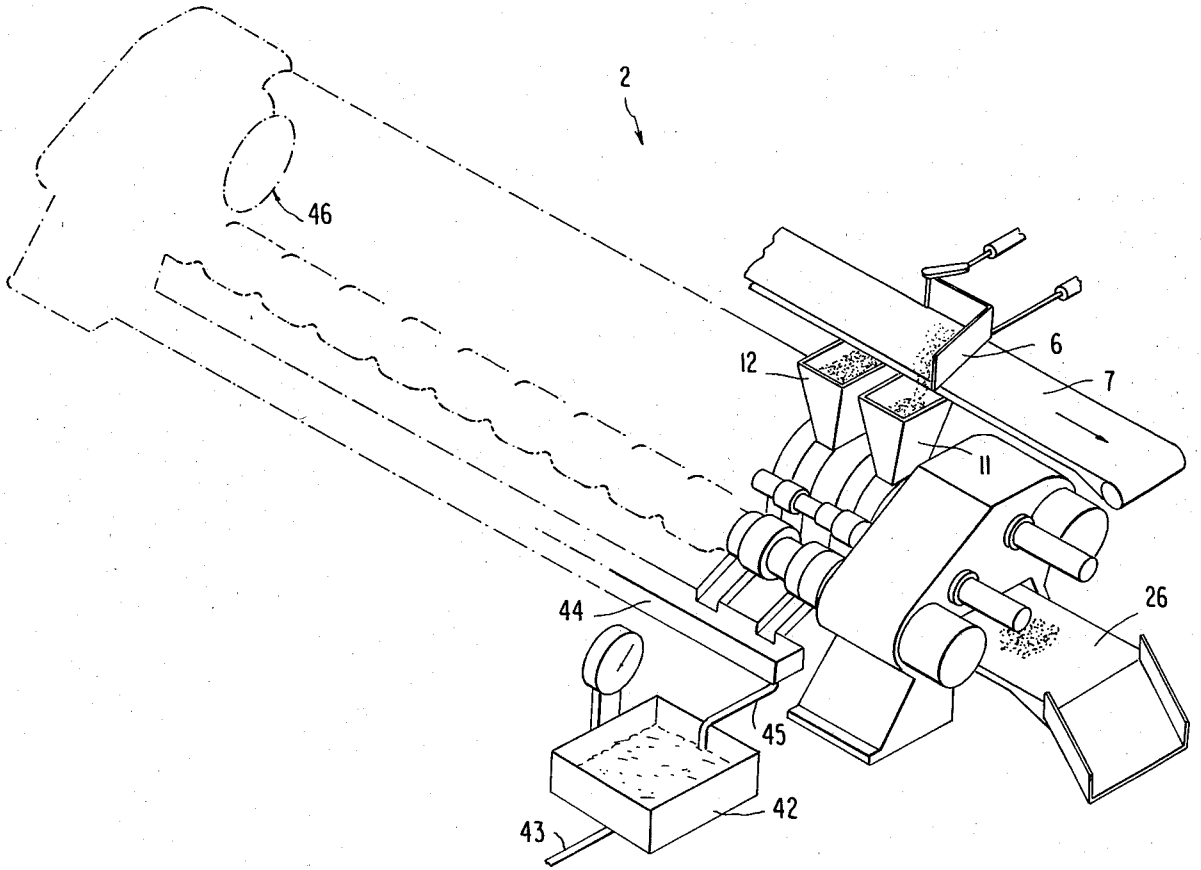
FIG. 3 is a perspective view of the feeding mechanism and peanut press of the present invention.

FIG. 3 is a perspective view, as seen from the rear generally of FIG. 1. FIG. 3 shows the arrangement of the product conveyor belt 26, the product feed conveyor 7, the diverting gate structure 6 (which is preferably an automatic gate mechanism), and individual supply hoppers 11 and 12. Also shown is an oil weighing tank 42, for determining the weight of oil extracted during operation of the peanut press 2. The oil weighing tank 42 has a weighing tank output line 43. An oil trough 44 collects oil from the respective oil run-off pipes 38, 39. The oil trough 44 conducts oil to a weighing tank inlet line 45. From there, oil is received in the oil weighing tank 42 where it is weighed.

The peanut press 2 of the peanut invention need not have four press chambers and respective intermediate holding hoppers, but may have any number of press chambers (each having a respective intermediate holding hopper). Furthermore, the entire operation of the press may be made automatic, including operation of the diverting gates, operation of the supply hopper release gate 36, operation of the volumetric feed chamber release gate 37, as well as operation of the press 2 until a predetermined amount of oil corresponding to a percentage of the totalized weight measured by the totalizing weighing chamber 5, has been obtained. Such automatic operation may be accomplished by any types of known control, such as cam operation, timed operation, feedback loop control operation using hydraulic or pneumatic or even electrical supply, or use of a computer control to synchronize and run each of the steps for an appropriate amount of time.

In operation, a supply of peanuts is delivered to the supply hopper 3. The supply hopper release gate 36 is then opened and remains open until the volumetric feed chamber is filled, at which point the release gate 36 is closed. At that time, the volumetric feed chamber release gate 37 is then opened. This permits a predetermined volume of peanuts, corresponding to the volume inside the feed chamber 4, to be deposited by gravity into the weighing chamber 5. The weighing chamber 5 has a means for determining weight of the peanuts, so as to determine the weight of the peanuts released from chamber 4. The weighing may be done by mass balance, by deformation of spring elements under the weight of the peanuts (as indicated schematically in FIG. 1), by an electronic load-transducing element, or by any other known means of sensing weight. All such weight sensing means are contemplated as being within the scope of the present invention.

The contents of the weighing chamber 5, following the weighing operation, are then released upon the conveyor belt 7. The release may be accomplished by tipping of the chamber 5, opening of the bottom of the chamber, or of the side of the chamber, or by any known means of removing articles from a chamber. This is not a limiting feature of the present invention, and any known means of removing peanuts from the chamber 5 is contemplated as being within the scope of the present invention.

The conveyor belt 7 carries the portion of the peanuts 50, received from the chamber 5, until the peanut portion 50 is diverted by one of the diverting gates 6. The diverted peanuts then fall off the conveyor belt 7 and into one of the intermediate holding hoppers 11–14. Any number of respective diverting gates, intermediate holding hoppers, and press chambers is contemplated, and not just the four shown in the figures. For example, twelve press chambers (and respective intermediate holding hoppers and respective diverting gates) may be used.

During this step, a new supply of peanuts is entered in chambers 4, and then 5, which is then released onto the conveyor belt 7 at which point a different diverting gate 6 is activated to divert the peanut portion 50 into an empty intermediate holding hopper. This step is repeated until each of the intermediate holding hoppers 11–14 has received a portion 50 of peanuts. When each of the intermediate holding hoppers has received a portion 50 of peanuts, the common fill gate member 18 is operated by the gate operator 15 so as to open the bottoms of the intermediate holding hoppers 11–14. The peanuts in each of the intermediate holding hoppers 11–14 falls into respective press chambers 21–24. The volume of peanuts is such that each of the press chambers 21–24 is substantially completely filled with peanuts. This results in economy of operation, since more peanuts can be processed when each of the press chambers 21–24 is filled and when each of the press chambers is only partially filled.

The hydraulic pump 19 is actuated to move the hydraulic ram member 46 so as to apply a uniform pressure to the peanuts in each of the press chambers 21–24. This is accomplished by use of pistons separating the ram from the first press chamber, and each of the press chambers from adjacent press chambers. An oil run-off pipe is supplied at one end of each of the pistons, to drain off oil squeezed from the peanuts. The oil run-off is collected during the pressing operation in a trough 44, which in turn is connected by a line 45 to an oil weighing tank 42.

Based upon the totalized weight of peanuts supplied to the peanut press, which totalized weight was obtained from the operation of the totalizing weighing chamber 5, a predetermined percentage of oil is to be extracted. This percentage of oil corresponds to a predetermined, desired product oil composition, such as is required by law to be placed upon labels attached to a retail product. Due to the precision of the measurements involved, a reliable indication of the percentage of oil removed from the peanuts, by weight, is obtained. The peanut press 2 continues to run and to extract oil until such time as the weight indicated by operation of a weighing mechanism associated directly with the oil weighing tank 42 has reached that weight corresponding to the predetermined percentage of the totalized weight; the totalized weight is indicated on the press by the total weight indicator 25.

The limit of operation of the press 2 can be made automatic, that is, the press 2 may run until a predetermined percentage of oil corresponding to that set by the indicator 25, has been reached. Also, the setting of the totalized weight in indicator 25 may be automatically performed by automatically taking the output of the totalized weight obtained by operation of the totalizing weighing chamber 5, by any conventional or known system or device for doing this. Such may be accomplished by use of a computer control, or by a hydraulic or dramatic control system, or the like. Also, this step may be performed manually based upon the information obtained from the totalizing weighing chamber 5 and displayed for the operator, who may then in turn set the weight in the indicator 25. The percentage may be taken by a hand calculation, or by an automatic operation such as by a calculator or the like, or by a cam, or by any other known means of determining a percentage of a given number.

When the operation of the press stops, the pressure on the pistons is removed, and the formed cake is released through the bottom of the press 2, as shown in FIG. 2(*d*). At this time a new supply portion 50' of peanuts is supplied to the intermediate holding hopper 11, and the entire cycle is repeated.

The product cakes 50, shown as being released in FIG. 2(*d*), fall upon a moving conveyor belt 26 which carries the product cakes 50 away from the peanut press 2 for further handling or processing thereof.

Although a particular peanut press 2 is shown, it is contemplated as being within the scope of the present invention that any type of press may be used, together with an oil-weighing device or apparatus, so that a precisely measurable amount of oil extracted may be used to determine the point at which the correct percentage of oil has been removed, based upon the total weight of the peanuts supplied. Such a device may include a hand press and a laboratory scale, for example. Also contemplated is a centrifuge for removing the oil, termination of the operation of the centrifuge being made when a predetermined percentage of oil has been extracted. In these examples, operation of the chambers 4 and 5 would be the same, to provide a predetermined volume to a weighing chamber for determining a weight supplied, and then using the total weight supplied to determine the amount of oil to be extracted.

The improved feed mechanism and operation of the peanut press described in the above, and forming the improved peanut press feed mechanism of the present invention is capable of achieving the above-enumerated objects and while preferred embodiments of the present invention have been disclosed, it will be understood that it is not limited thereto and may be otherwise embodied within the scope of the following claims.

What is claimed is:

1. An apparatus for removing a predetermined percentage by weight of liquid from a product, comprising:

a volumetric feed chamber adapted to receive an entering product;

a weighing means adapted to weigh the entering product;

a means for transferring a predetermined volume of the entering product from said volumetric feed chamber to said weighing means;

a means for applying pressure to the entering product to extract a predetermined amount of liquid therefrom as a percentage by weight of the entering product;

a means for transferring the entering product from said weighing means to said means for applying pressure;

a means for removing the entering product from said means for applying pressure, after said predetermined amount of liquid has been removed from the entering product;

said weighing means comprising a weighing chamber;

said means for applying pressure including a hydraulic press; said hydraulic press having a plurality of press chambers; each one of said plurality of press chambers having a chamber volume generally equal to said predetermined volume of the entering product;

a release gate disposed beneath the feed chamber adapted to release contents of said feed chamber;

said weighing device being disposed directly beneath said release gate;

whereby said hydraulic press removes said predetermined percentage of liquid from the entering product while filling said plurality of press chambers, regardless of variations in mass density of the entering product.

2. An apparatus as claimed in claim 1, further comprising:

at least one diverting means for diverting product to said means for applying pressure.

3. An apparatus as claimed in claim 1, further comprising:

a conveyor belt directly underlying the weighing device;

at least one diverting gate associated with said conveyor belt adapted for diverting the supply of said product from the conveyor belt;

said means for pressing the product having an inlet underlying said means for diverting, such that diverted product falls toward said inlet opening.

4. An apparatus as claimed in claim 7, further comprising:

an intermediate holding hopper directly underlying said at least one diverting means;

and a fill gate closing a bottom of said intermediate holding hopper.

5. A device as claimed in claim 4, further comprising:

a press chamber being open at the top, adapted for receiving said product from said intermediate holding hopper when said fill gate member is operated to permit falling of product from the intermediate holding hopper.

6. An apparatus as claimed in claim 1, further comprising:

an intermediate holding hopper for supplying each of one of said plurality of press chambers, adapted to receive material from said means for transferring material from said weighing means to said means for applying pressure;

each said intermediate holding hopper being selectively openable along bottom portion thereof for releasing the product therein.

7. An apparatus as claimed in claim 6, wherein at least a diverting gate comprises a portion of said means for transferring said product from said weighing means to said means for applying pressure.

8. An apparatus as claimed in claim 7, wherein said means for transferring said product from said means for weighing to said means for applying pressure further comprises a conveyor belt directly underlying said means for weighing:

said at least one diverting gate being adapted to selectively block material moving with said conveyor belt into said at least one intermediate holding hopper.

9. An apparatus as claimed in claim 8, further comprising:

a means for removing product from said means from applying pressure.

10. An apparatus as claimed in claim 9, further comprising:

a means for determining weight of liquid removed from the material;

and a means for determining total weight of material supplied to said means for applying pressure;

whereby operation of said means for applying pressure is terminated once a predetermined percentage, by weight, of liquid has been removed from the material.

11. An apparatus as claimed in claim 10, further comprising:

a means for removing material from said means for applying pressure.

* * * * *